US008256494B2

(12) United States Patent
Reifferscheid et al.

(10) Patent No.: US 8,256,494 B2
(45) Date of Patent: Sep. 4, 2012

(54) METAL-STRIP GUIDING APPARATUS

(76) Inventors: Markus Reifferscheid, Korschenbroich (DE); Juergen Seidel, Kreuztal (DE)

( * ) Notice: Subject to any disclaimer, the term of this patent is extended or adjusted under 35 U.S.C. 154(b) by 0 days.

(21) Appl. No.: 13/284,875

(22) Filed: Oct. 29, 2011

(65) Prior Publication Data

US 2012/0043048 A1 Feb. 23, 2012

Related U.S. Application Data

(62) Division of application No. 12/375,542, filed as application No. PCT/EP2007/007193 on Aug. 15, 2007, now abandoned.

(30) Foreign Application Priority Data

Aug. 25, 2006 (DE) ..... 10 2006 040 012

(51) Int. Cl.
*B22D 11/128* (2006.01)

(52) U.S. Cl. ..... 164/442; 164/448; 164/484

(58) Field of Classification Search ..... 164/442, 164/448, 476, 484; 29/527.5–527.7; 492/1–3, 492/6, 7, 47
See application file for complete search history.

(56) References Cited

U.S. PATENT DOCUMENTS 3,774,671 A * 11/1973 Rossi ..... 164/424
4,116,261 A * 9/1978 Puhringer et al. ..... 164/448
7,972,253 B2 * 7/2011 Pettersson ..... 492/4

FOREIGN PATENT DOCUMENTS

JP 06015424 A * 1/1994
JP 06154979 A * 6/1994

OTHER PUBLICATIONS

JPO machine translation of JP 06015424 A, Jan. 25, 1994.*
JPO machine translation of JP 06154979 A, Jun. 3, 1994.*

* cited by examiner

*Primary Examiner* — Jessica L Ward
*Assistant Examiner* — Kevin E Yoon
(74) *Attorney, Agent, or Firm* — Andrew Wilford

(57) ABSTRACT

A continuous-casting unit produces a longitudinally extending and traveling strand having a solid shell and a liquid core. A strand-guiding apparatus has a plurality of longitudinally spaced section frames and respective pairs of roller assemblies carried on the frames and transversely flanking and bearing transversely on the strand. Each pair forms a gap through which the strand passes, and each roller assembly is formed by two aligned subrollers. A respective center is provided bearing between the subrollers of each roller assembly and bracing inner ends of the respective subrollers transversely against the respective frame. Respective outer rollers at outer ends of the subrollers of each roller assembly brace the respective outer ends transversely against the respective frame. The subrollers are shaped or supported on the respective frame such that in an unloaded condition the gap is transversely narrower at the center bearing than at the outer bearing.

3 Claims, 3 Drawing Sheets

METAL-STRIP GUIDING APPARATUS

CROSS REFERENCE TO RELATED APPLICATION

This application is a division of application Ser. No. 12/375,542 filed 29 Jan. 2009 now abandoned as the US-national phase of PCT application PCT/EP2007/007193 filed 15 Aug. 2007 and published 28 Feb. 2008 as WO 2008/022731 with a claim to the priority of German application 10 2006 040 102.7 filed 26 Aug. 2006.

FIELD OF THE INVENTION

The invention relates to a strand-guiding apparatus and a method of guiding a metal strip that has not yet completely solidified, in particular, a thin slab in a continuous-casting installation.

BACKGROUND OF THE INVENTION

The profile of a slab, in particular, of a thin slab, must meet strict requirements in terms of its bowing or thickness taper when the slab leaves a continuous-casting installation and is passed to a rolling mill. For example, the required tolerances for a profile camber in a thin slab that is to be sent to a compact-strip-production (CSP) finishing train are in the range of 0.5% to 1% relative to the slab thickness. This means that the profile camber, e.g. in a 50 mm thick slab, must only measure between 0.25 mm and 0.5 mm. In addition, this profile camber should be as constant as possible over the entire length of the slab.

The reason for the profile camber in metal strips is what is called ferrostatic pressure that is present inside the metal strips that have not yet completely solidified and that presses from inside against the strand shell, thereby causing an outward crowning of the strand shell. It is true that this ferrostatic pressure is essentially constant inside the liquid part of the strand; however, the pressure increases as the liquid part of the metal strip becomes longer. This bulging of the strand shell caused by the ferrostatic pressure results in a loading of the guide rollers guiding the metal strip in the strand-guiding apparatus and transmit this loading through their bearings to a section frame on which the guide rollers are mounted by means of bearings. The load being transmitted typically results in a deflection or spring-back of the section frame, in particular, in the area of center bearings in the case of divided guide rollers. This undesirable spring-back of the section frame typically results in an undesirable change in the roller gap geometry, and thus in particular in an undesirably large profile camber in the metal strip guided in the strand-guiding means. Due to the undesirable profile camber, the metal strip often as a result no longer meets the requirements of the downstream rolling mill.

These problems are known in the art and are discussed, e.g. in EP 1,043,095 [U.S. Pat. No. 6,568,460]. Here it is emphasized that the most critical factor in maintaining the above-mentioned norms is to precisely control the roller gap geometry in the area of residual solidification in light of the above-referenced problems. For this purpose, this European patent teaches an approach whereby a force-exerting means in the form of a hydraulic cylinder is provided in the center region of the section frame, i.e. in the area of the center bearings so as to compensate for the above-referenced undesirable spring-back of the section frame.

These hydraulic cylinders are, however, very costly both in terms of acquisition as well as maintenance, and additionally entail ongoing operating costs, e.g. due to the regular consumption of electrical power.

OBJECT OF THE INVENTION

Based on this prior art, the basic object to be attained by the invention is to provide alternative means of implementing an at least partial compensation of section spring-back for a known strand-guiding apparatus and for a known method of guiding a metal strip, in particular, one not yet completely solidified.

SUMMARY OF THE INVENTION

This object is attained by the features of claim 1. This is characterized in that the means for at least partially compensating for the section spring-back is designed either in the form of a bowing of the intermediate-mounted guide roller and/or in the form of a more yielding design of the outer bearings as compared with the center bearing and/or in the form of a greater distance between the section frame and the center axis of the subrollers at the center bearing than at the outer bearings.

The invention takes the described spring-back of the section frame in the area of the center bearings under load as a given; no attempt is made to modify the extent of the spring-back by another design, in particular, by stiffening the section frame.

Instead, all three claimed proposals effect an at least partial compensation of the section spring-back by an approach whereby, despite the spring-back of the section frame the roller gap, geometry is not modified, or is modified only within tolerable limits relative to a load situation without the claimed means.

All three claimed means can be implemented relatively cost effectively; in particular, they do not require any ongoing operating costs for continuously consumed operating resources such as electric power or oil.

The following description of the invention differentiates between an "unloaded" state and a "loaded state" for the strand-guiding apparatus.

The term "unloaded state" of the strand-guiding apparatus means that no metal strip is being passed through the roller gap.

Conversely, "loaded state" denotes the situation in which a metal strip, in particular a metal strip that is not yet completely solidified, passes through the roller gap. As has already been described in the introduction, an internal ferrostatic pressure is present in the incompletely solidified metal strip, which pressure forces the strand shell of the metal strip outward, thereby basically causing a profile camber of the metal strip. The ferrostatic pressure also acts indirectly through the strand shell on the guide rollers of the strand-guiding apparatus, and also in turn though the guide rollers on the section frame. Ultimately, the pressure on the section frame causes a spring-back of the section frame, in particular, in the area of the center bearings.

What is important is the fact that all three of the claimed means according to the invention for compensating for the section spring-back are designed and present irrespective of whether the strand-guiding apparatus is considered under load or in the unloaded state. This does not conflict with the fact that the cross-section of the roller gap changes in each case as a function of load.

The claimed means for (partially) compensating for the section spring-back advantageously provide a limitation or adjustment of the undesirably large profile camber of the metal strip caused by the ferrostatic pressure down to a permissible threshold value.

Special embodiments of the means are described in the dependent claims.

If a plurality of guide roller pairs is disposed one after the other in the travel direction of the metal strip, it is advantageous if at least some of the means according to the invention for compensating for the spring-back of the section frame in the travel direction of the metal strip are calibrated so as to tend to be increasingly stronger at the guide rollers.

The aim of this feature is to solve the following set of problems: The position of the low point of the liquid core, and thus the length of the incompletely solidified region in a metal strip in a strand-guiding apparatus is significantly determined by the casting parameters: casting rate, superheating, and amount of secondary cooling. Basically, the still-liquid part of the metal strip increases in length as the casting rate becomes faster and cooling is reduced. The longer the still-liquid part of the strand, however, the greater is the ferrostatic pressure inside the metal strip. The claimed increasingly stronger design of the means for compensating for the spring-back advantageously effects a necessarily greater counter-pressure on metal strips with especially long regions that have not yet solidified completely. The greater prevailing ferrostatic pressure is then counteracted to a sufficiently large degree by the claimed design of the means, in particular, in the area of final solidification of the metal strip. Advantageously, the claimed compensation of the section spring-back, which tends to become stronger or increase in the travel direction of the metal strip, allows for the formation of a desirable, at least approximately constant profile camber over the entire length of the metal strip, and specifically and advantageously independently of the level of the prevailing casting parameters in operation, such as casting rate, superheating, or level of the secondary cooling.

The above problem is furthermore solved by a method of in particular guiding an incompletely solidified metal strip. The advantages of this method correspond to the advantages of the embodiment discussed in the last paragraph.

BRIEF DESCRIPTION OF THE DRAWING

The invention is described with reference to four figures in which.

DETAILED DESCRIPTION

The following discussion describes in more detail the invention in the form of illustrated embodiments with reference to the above-mentioned figures. In the individual figures, identical elements are denoted by identical reference numbers.

Figure 1:
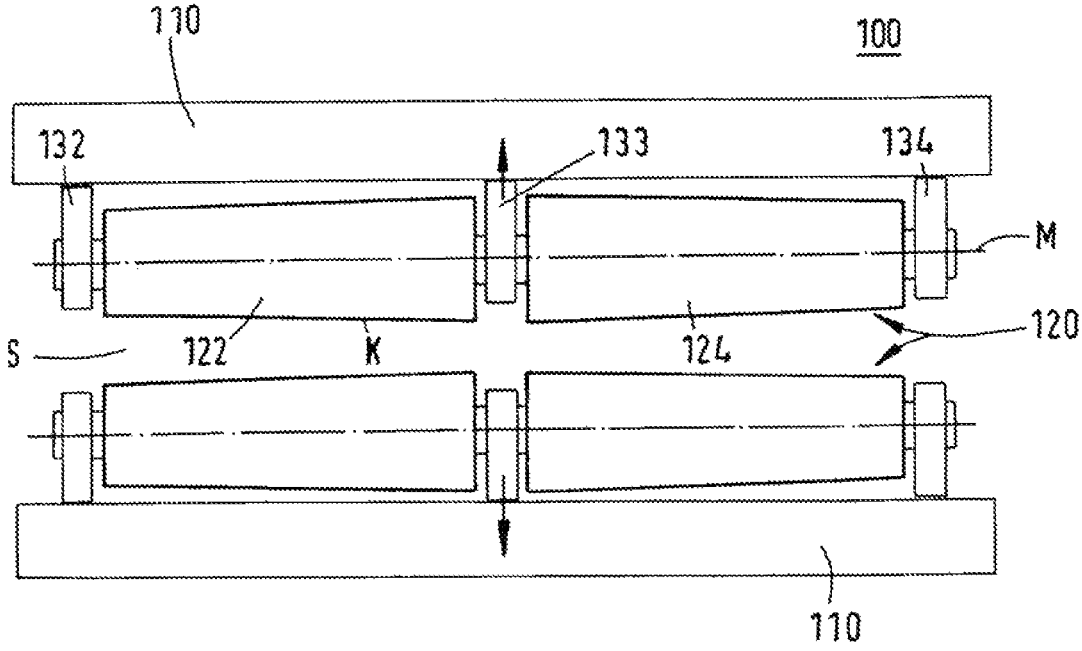
FIG. 1 shows a first embodiment of the means according to the invention for compensating for spring-back of the section frame.
Figure 2:
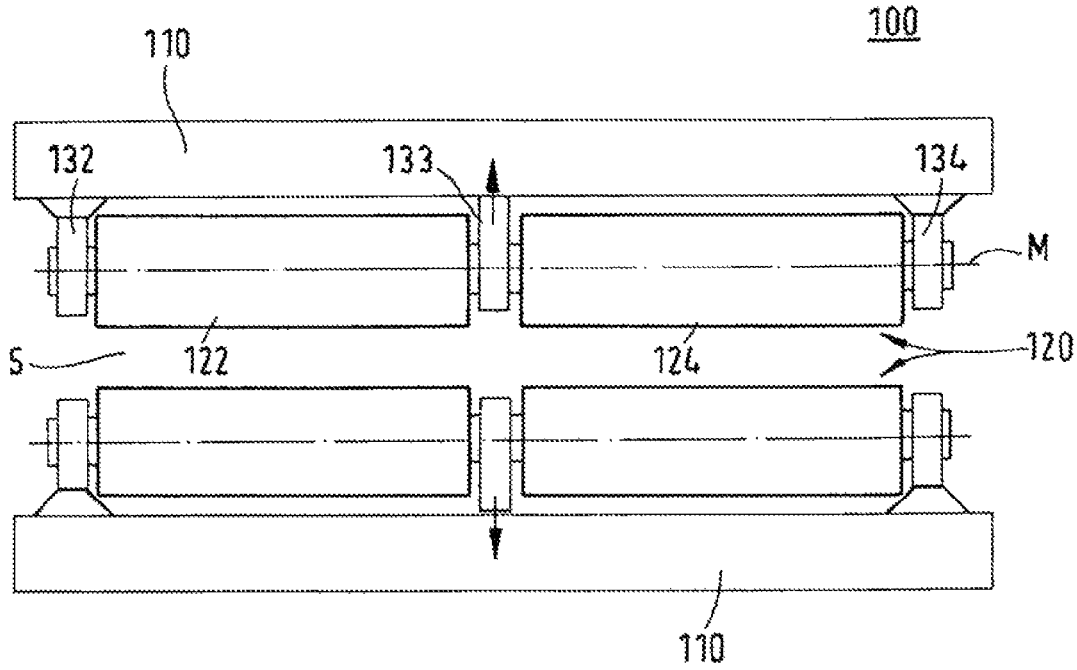
FIG. 2 shows a second embodiment of the means according to the invention.
Figure 3:
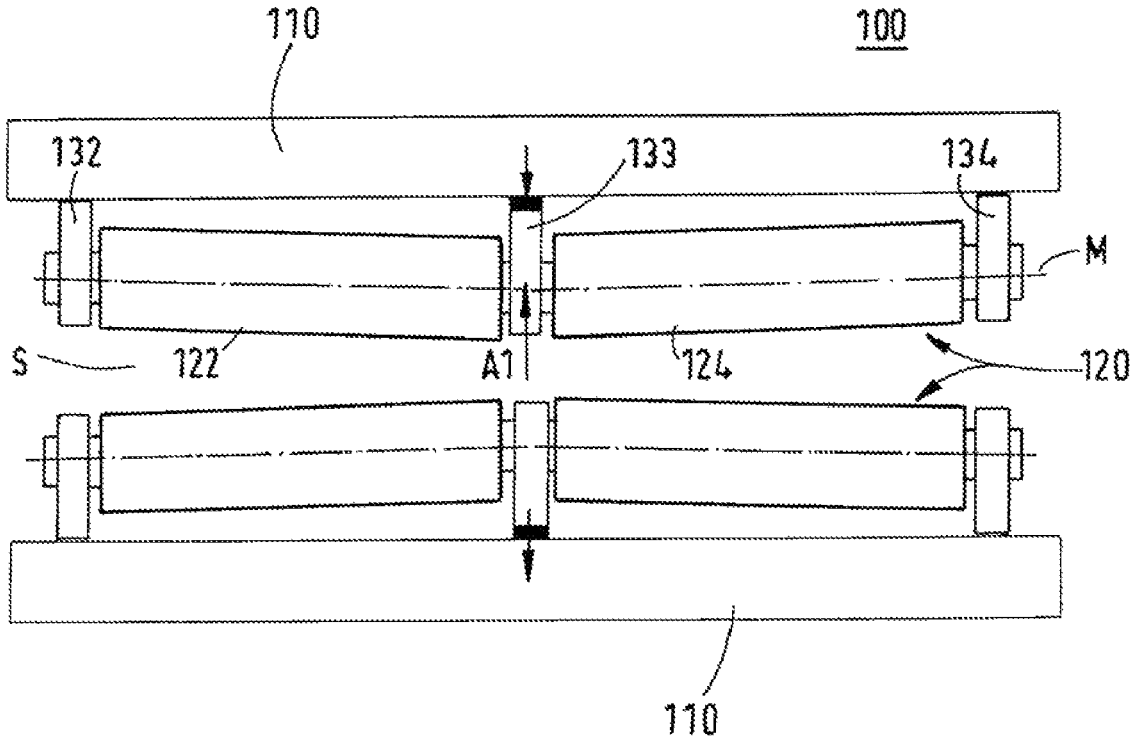
FIG. 3 shows a third embodiment of the means according to the invention.

FIGS. 1-3 each illustrate a cross-section of a strand-guiding apparatus 100 of a continuous-casting installation in particular for guiding an incompletely solidified metal strip, such as for example a thin slab (not shown in the figures). The strand-guiding apparatus 100 comprises a section frame 110 that in the figures is shown as the illustrated frame crossbeams 110. At least one pair of juxtaposed guide rollers 120 is rotatably supported on the section frame. The two juxtaposed guide rollers 120 span a variable roller gap S through which the metal strip (not shown) is passed. In this invention, the guide rollers 120 have at least a single division; in the drawing each guide roller 120 is composed, by way of example, of two adjacent aligned subrollers 122 and 124. In each case, the subrollers are rotatably supported on the section frame or on the section crossbeam 110 by outer bearings 132 and 134, and at least one common center bearing 133.

In all three views—FIG. 1, FIG. 2, and FIG. 3—the section frame together with the guide rollers is shown in the unloaded state. When under load, i.e. when the incompletely solidified metal strip with a profile camber is passed through the roller gap S, the section frame is subject to a high load, in particular, in the region of the center bearings 133 and then bends there. The direction of the deflection is indicated in FIGS. 1 and 2 by the arrows at the center bearings 133.

In terms of a first means for at least partially compensating for this section spring-back, the invention proposes a bowing of the centrally supported guide rollers, as illustrated in FIG. 1. In order to effect the bowing in a guide roller with a single center bearing, the guide roller's two subrollers 122 and 124 are each designed as tapered with a straight-line or convex shape K. Each of the thus designed subrollers is supported at its larger-diameter end on the common center bearing 133. When under load (not shown in FIG. 1), center bearings 133 are pushed apart away from the center of roller gap S to a higher degree than do the outer bearings due to the referenced spring-back of the section frame; the negative bowing shown in FIG. 1 for the unloaded state is then at least partially cancelled out, or changed into a linearly delimited roller gap, or even into a roller gap having a slight desirable positive bowing corresponding to the desired slight profile camber in the metal strip. The bowing of the subrollers or of the guide rollers is advantageously designed to be parabolic or as determined by a polynomial function.

FIG. 2 illustrates a second means for at least partially compensating for spring-back of the section frame. This second means consists in designing outer bearings 132 and 134 to be suspended in a more yielding or softer fashion than the at least one center bearing 133 in the area of maximum section spring-back. If multiple center bearings are present, the center bearings are advantageously suspended in increasingly firmer fashion toward the center of the metal strip since the amplitude of the spring-back for the section frame due to mechanical factors increases toward the center of the section frame or of the section crossbeam, whereas this amplitude decreases toward the ends. In one variant of this second embodiment, the center bearing can also be rigid in the area of center of the metal strip, i.e. not using a cushioned design; this variant is illustrated in FIG. 2. What then results under load (not shown in FIG. 2) is the referenced maximum spring-back of the section crossbeam in the area of center bearing 133 and only a lower loading in the area of outer bearings 132 and 134. What then results in overall terms under load is preferably a slight positive bowing of roller gap S that corresponds to a profile camber of the rolled metal strip within the desired range. By appropriately dimensioning or designing the spring rates in the area of the outer bearing and the center bearing, it is possible to set the desired profile camber very precisely.

FIG. 3 shows a third embodiment of the means according to the invention for partially compensating for the section spring-back. As is evident in FIG. 3, the especially strong section spring-back there in the area of the center bearing 133 is at least partially compensated for by the fact that the distance A1 between the section frame 110 and center axis M of subrollers 122 and 124 is designed to be larger for the center bearings 133 than for the outer bearings 132 and 134. In this embodiment as well, the negative bowing of the roller gap shown in FIG. 3 for the unloaded state is evened out or even overcompensated for in the loaded state, thereby resulting in a roller gap or profile of the metal strip with linearly delimited parallel broad faces, or a metal strip with a desired very slight profile camber.

All of the claimed means according to the invention for an at least partial compensation of the spring-back of the section frame can be employed not only singly but also in any desired combination with one another.

Figure 4:
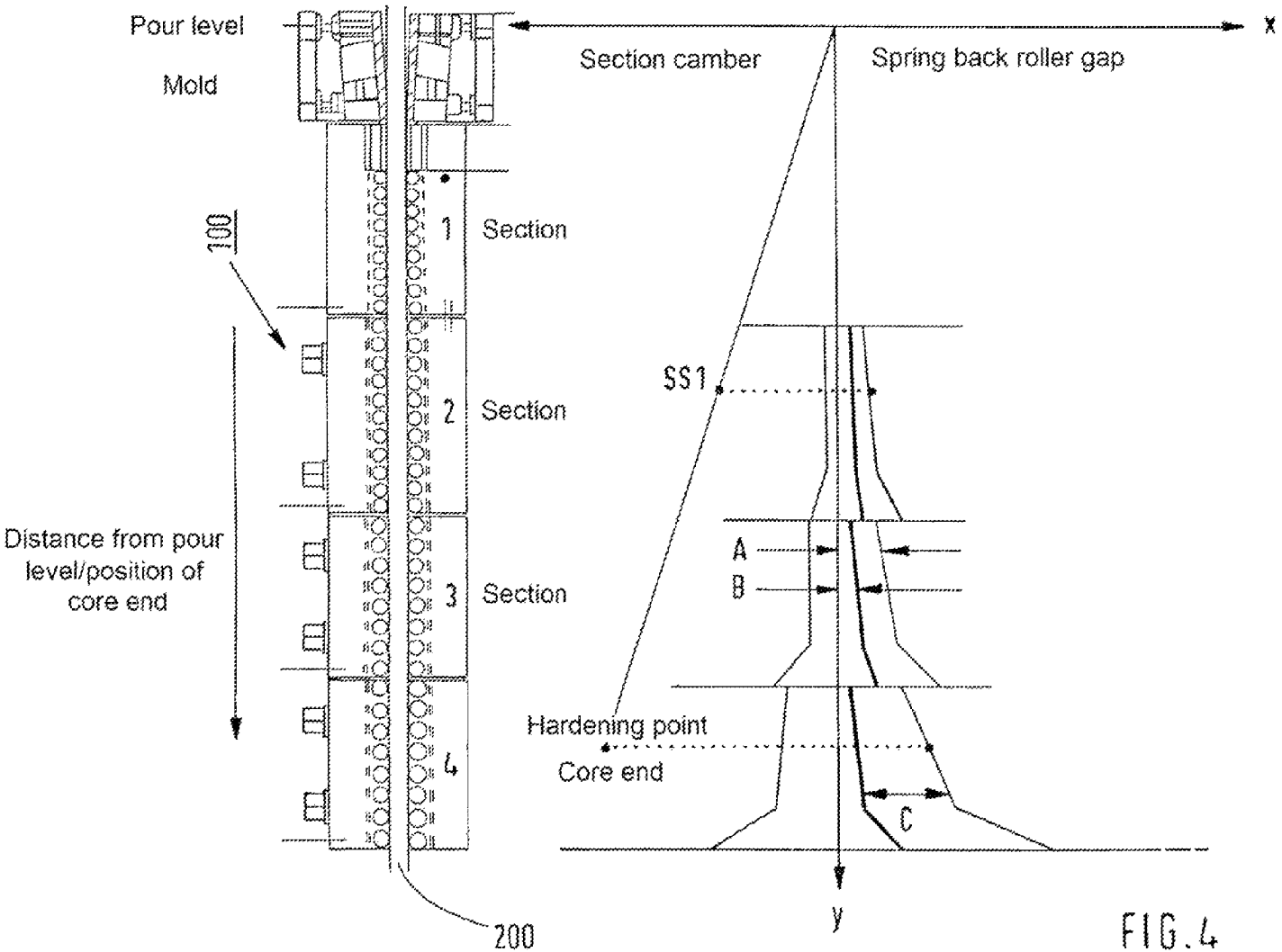
FIG. 4 shows the connection between the position of the lowest point of the liquid core, spring-back of the section frame dependent thereon, and the partial compensation according to the invention of the section spring-back.

FIG. 4 shows the path of a metal strip 200 through a downstream vertical strand-guiding apparatus 100 after casting in a mold. The diagram at right next to the illustrated strand-guiding apparatus uses line sections to show at the extreme outer right the spring-back in each case of the section frame or of the section crossbeams in the individual sections as a function of the position of the solidification point or of the lowest point of the liquid core. In concrete terms, the diagram in FIG. 4 is read as follows: At a certain position of the lowest point of the liquid core, i.e. at a certain distance of the lowest point of the liquid core from the upper surface, identified by way of example as SS1 in FIG. 4, the amplitude of the associated spring-back of the guide rollers in the second section of the strand-guiding apparatus is found by following the dotted line starting from point SS1 horizontally, i.e. along the x axis to the right. The amplitude of the given spring-back is then found as distance A of the line at the extreme outer right of the y axis. It is evident that the spring-back tends to increase with increasing distance from the upper surface, i.e. in the y axis. This effect is explained by the fact that in these cases the solidification point or lowest point of the liquid core is located only at a relatively late point within the strand-guiding apparatus, that accordingly the incompletely solidified region of the metal strip is relatively large, and that accordingly the ferrostatic pressure responsible for the bending up or spring-back of the section frame is especially large.

The breaks in the lines shown in FIG. 4 at the extreme outer right indicate a design or mechanically based softer suspension of the guide rollers at the end of the individual sections.

Finally, the bold lines illustrate the extent of spring-back when the means according to the invention for partially compensating for the spring-back are employed. It is evident that the spring-back of the section frame resulting when the means according to the invention are used is significantly smaller than the spring-back of the section frame represented by the lines at the outer right without the means according to the invention; compare distance B with distance A. Finally, it is also evident in FIG. 4 that the distance C between the respective bold lines and the lines at the outer left become increasingly larger with an increasing number of sections, i.e. with increasing distance from the upper surface. This increasing distance C illustrates an advantageously increasing compensation performance by the correspondingly more strongly designed means. This stronger design of the means, e.g. in the form of a stronger bowing of the subrollers toward the center of the roller gap, or in the form of an enlargement of the distance between the section frame and the center axis of the subroller at the center bearings, or due to an increasingly firmer suspension of the center bearing as compared with the edge bearings with increasing distance from the upper surface advantageously provides an at least approximate stabilization of the desired profile camber in the metal strip in the region of residual solidification or at the outlet of guide apparatus 100. The referenced approximate stabilization of the profile camber in FIG. 4 is evidenced by the fact that distance B between the y axis and the bold lines remains at least approximately constant over the entire length of the strand-guiding apparatus; at least this distance B, or the corresponding profile camber, do not change nearly to the extent that would be the case without the use of the means according to the invention, this being represented by distance A between the line sections at the extreme outer left and the y axis.

We claim:

1. In combination with a continuous-casting unit producing a strand extending and traveling in a longitudinal travel direction and having a solid shell and a liquid core, a strand-guiding apparatus comprising:

a plurality of longitudinally spaced section frames;

respective pairs of roller assemblies carried on the frames and transversely flanking and bearing transversely on the strand, each pair forming a gap through which the strand passes, each roller assembly being formed by two aligned subrollers;

a respective center bearing between the subrollers of each roller assembly and bracing inner ends of the respective subrollers transversely against the respective frame;

respective outer bearings at outer ends of the subrollers of each roller assembly bracing the respective outer ends transversely against the respective frame, the subrollers being shaped or being supported on the respective frame such that in an unloaded condition the gap is transversely narrower at the center bearing than at the outer bearing, the outer bearings including respective cushioned supports by means of which they are more transversely deflectable than the respective center bearings.

2. The apparatus defined in claim 1 wherein the subrollers have outer surfaces engageable with the strand and centered on respective axes.

3. The apparatus defined in claim 2 wherein the subrollers are substantially cylindrical and the axes of the subrollers of each roller assembly meet at a large acute angle at the respective center axis.

* * * * *